United States Patent [19]

Andersen

[11] 4,387,897

[45] Jun. 14, 1983

[54] GAME APPARATUS

[76] Inventor: Cyril F. Andersen, 1491 Ute Dr., Salt Lake City, Utah 84108

[21] Appl. No.: 896,608

[22] Filed: Apr. 14, 1978

[51] Int. Cl.[3] ..... A63F 3/00

[52] U.S. Cl. ..... 273/276; 273/153 P

[58] Field of Search ..... 273/153 P, 276, 290, 273/256, 272; 35/22 R, 22 A

[56] References Cited

U.S. PATENT DOCUMENTS

| | | | |
|---|---|---|---|
| 983,730 | 2/1911 | Leach | 273/153 P |
| 1,565,901 | 12/1925 | Brandt | 273/153 P |
| 2,595,938 | 5/1952 | Grant | 35/73 X |
| 2,839,842 | 6/1958 | Keyko | 35/22 R |
| 2,896,950 | 7/1959 | Rosti | 273/258 |
| 3,484,105 | 12/1969 | Winston | 35/22 R X |
| 3,649,018 | 3/1972 | Beam | 273/276 X |
| 3,817,531 | 6/1974 | King | 273/276 X |
| 4,014,548 | 3/1977 | Trilling | 273/272 |

FOREIGN PATENT DOCUMENTS

| | | | |
|---|---|---|---|
| 994566 | 8/1951 | France | 35/18 A |
| 5665 | of 1913 | United Kingdom | 35/18 A |
| 292490 | 10/1928 | United Kingdom | 273/276 |

OTHER PUBLICATIONS

"Troke", p. 11 of Dec. 1961, Playthings.

"Jiggered", p. 47 of Feb. 1976 Games & Puzzles, No. 45.

*Primary Examiner*—Harland S. Skogquist

*Attorney, Agent, or Firm*—Mallinckrodt & Mallinckrodt

[57] ABSTRACT

A game apparatus includes three designated construction sites and a discard site for each of one or more players, and a set of a plurality of playing pieces for each player. Each piece of a set of pieces is of similar geometric shape in one plane but each is of different perimetral size in that plane so that, beginning with the piece of largest perimetral size, all of the pieces of a set may be stacked, one on top of the other, to form a shape of constantly diminishing cross section such as a pyramid. The similarly sized pieces of each set are interchangeable. The apparatus also includes means, such as a playing board with designated draw locations or a box, for holding all playing pieces so that they may be drawn individually to be placed into play.

15 Claims, 7 Drawing Figures

GAME APPARATUS

BACKGROUND OF THE INVENTION

1. Field

The invention is in the field of game apparatuses, particularly board game apparatuses, for use by one or more persons.

2. State of the Art

There are many game apparatuses available today for playing a wide variety of games. One apparatus that has been in existence for a number of years comprises three pegs and a number of discs of differing circumferences, each disc having a central hole therethrough so that it may be placed on a peg. The object of the game is to place the discs on the pegs and move them from peg to peg in such a way that all discs end up on one peg progressing from the largest at the bottom to the smallest at the top. To obtain such an arrangement without ever placing a larger disc upon a smaller one adds additional challenge. While this game apparatus has provided an interesting solitare game, it has not been adapted to a board game with provision for competition among several players.

SUMMARY OF THE INVENTION

According to the invention, a game apparatus includes means, such as a board, designating three construction sites and one discard site for each of one or more players and a set of a plurality of playing pieces for each player. The building and discard sites for each player may be included on one large board or may be provided for each player on individual boards. Each piece of each player's set of pieces is of similar geometric shape in one plane but each piece has a different perimetral size in that plane so that, beginning with the piece of largest perimetral size, all of the individual pieces of a set can be stacked, one on top of the other, to form a shape, such as a pyramid or cone, of constantly diminishing cross section.

The pieces of all sets will generally be mixed at the beginning of a game and then individually drawn by players to be placed into play. The pieces of one set are interchangeable with similarly sized pieces of other sets so there is no distinction made between one player's pieces and another's. Means for holding all playing pieces so that they may be drawn individually to be placed into play may take the form of a playing board having a plurality of sites among which the pieces are divided and randomly stacked, or of a box in which all pieces are randomly placed.

THE DRAWINGS

The best mode presently contemplated for carrying out the invention is shown in the accompanying drawings, in which:

FIG. 1 is a top plan view of the playing boards of the invention;

FIG. 2, a top plan view of a different embodiment of the central playing board of FIG. 1;

FIG. 3, a side elevation of the embodiment of the central board shown in FIG. 2;

FIG. 4, a pictorial view of an assembled set of playing pieces;

FIG. 5, a top plan view of two of the playing pieces, one stacked on top of the other;

FIG. 6, a side elevation of the two stacked playing pieces of FIG. 5, showing playing piece interlocking features; and FIG. 7, a top plan view of differently shaped playing piece.

DETAILED DESCRIPTION OF THE ILLUSTRATED EMBODIMENT

Figure 1:
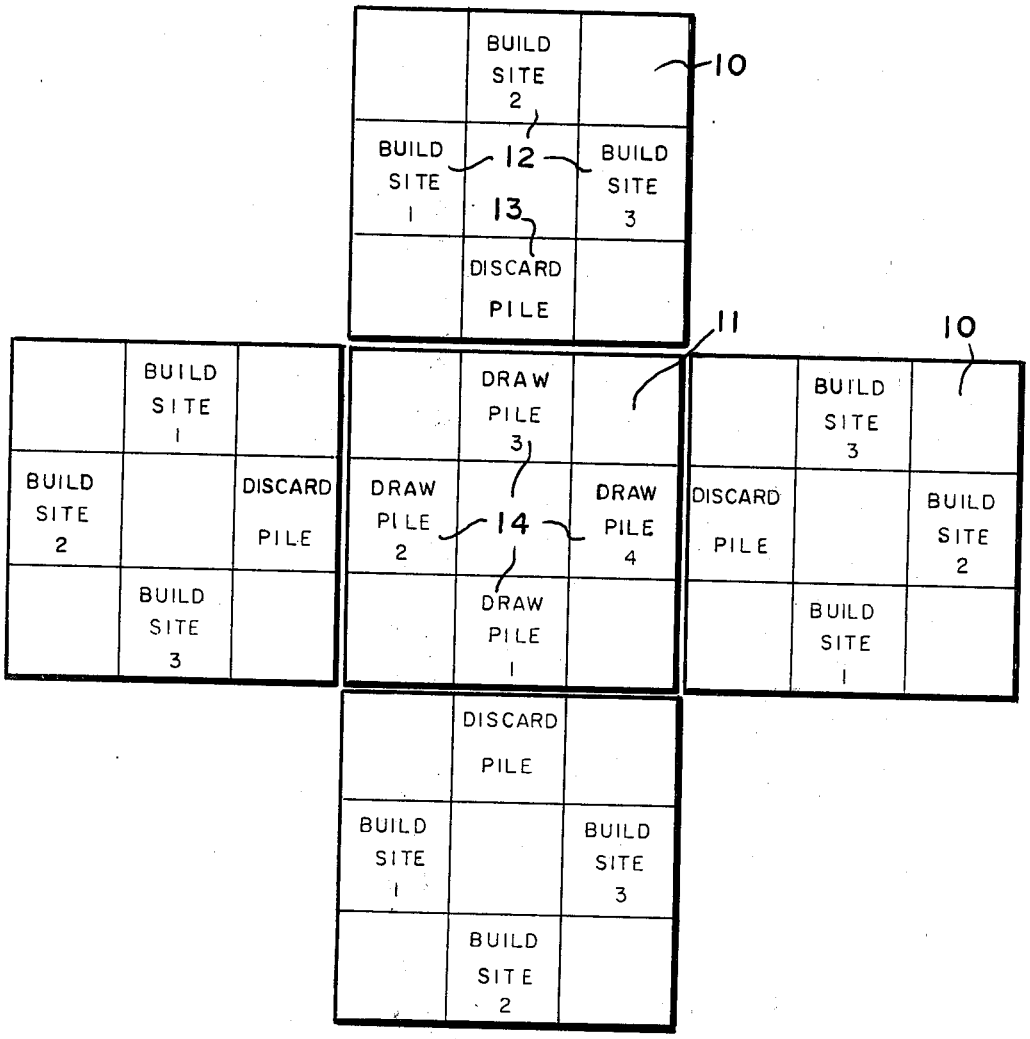

The game apparatus of the present invention preferably includes four similar individual playing boards 10, FIG. 1, and a central common playing board 11. Each of the individual boards 10 contain markings 12 which indicate construction sites and markings 13 which indicate discard sites. These are labeled in FIG. 1 as "Build Sites" and "Discard Piles", respectively. The number of boards 10 used during play of a game generally depends upon the number of players in that particular game. Usually one separate board 10 will be used by each player. Thus, with four boards provided, the game apparatus can accommodate up to four separate players. For accommodating only two players, the apparatus could be supplied with only two such playing boards. While the markings on boards 10 are identical, each board may be of a different basic color and may have different color printing.

Central playing board 11 contains markings 14 indicating preferably four separate sites thereon. These sites are labeled in FIG. 1 as "Draw Piles".

The individual boards described may be separate or may be joined at the abutting edges shown in FIG. 1 to form a single folding board. Alternatively, a large square board could be provided with construction and discard sites for each player located along the edges and the draw piles located in the center. The provision of separate boards is presently preferred, because of greater flexibility.

A set of stackable playing pieces 15 is provided for each board 10 that is provided. Generally, a set of playing pieces will be put into play for each player in any particular game. Thus, if there are three players, three playing boards 10 will be used and three sets of playing pieces will be used.

Figure 4:
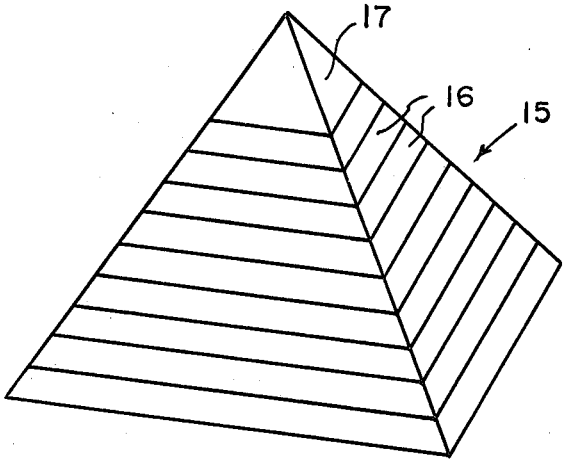
Figure 5:
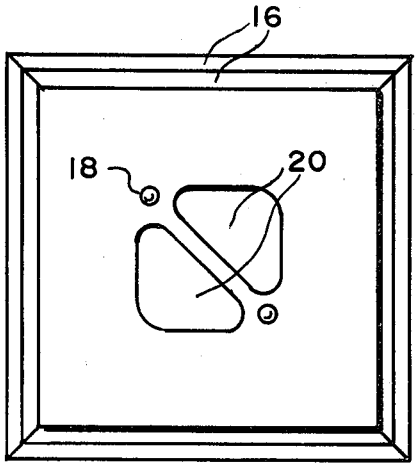
Figure 6:
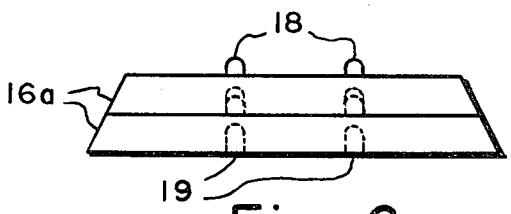

Each set of playing pieces is made up of a plurality of individual playing pieces 16. Each individual piece of a set is of similar geometric shape in one plane, but each piece is of a different perimetral size so that when all of the pieces of a set are stacked, one on top of the other and progressing from the piece of largest perimetral size on the bottom to the smallest on top, they form a shape of constantly diminishing cross section such as the pyramid shown in FIG. 4. As illustrated, playing pieces 16 are slices in the horizontal plane of the pyramid and each piece is of square configuration in that plane as shown by FIG. 5. Each square playing piece 16 of a set is of different perimetral size, i.e., the perimeter of the square formed by each piece is different, preferably by equal increments. The edges **16*a*, of the pieces may be perpendicular to the top and bottom surfaces to thereby form a step pyramid when assembled, or, as is preferred, they may be sloped as shown in FIG. 6**.

It is preferred that the thickness of each piece be equal, as shown, except for a top piece 17 of the pyramid that includes what otherwise would be several slices of the pyramid. The top several slices are combined into a single top piece so that all pieces of the set remain large enough to be easily handled. FIG. 4 shows a set of playing pieces made up of ten individual pieces, nine are equal thickness slices of the pyramid, and the tenth, which forms the top of the pyramid, is the equivalent of three slices. Ten pieces per set is preferred but any number more or less may be used. The length of a game increases with more pieces and decreases with less. Thus, with ten pieces supplied for a normal game, if a shorter than normal game is desired, a fewer number of pieces may be used, e.g., only the top five pieces.

The pieces of one set are indistinguishable from those of other sets so that pieces of similar size are completely interchangeable.

The individual pieces 16 may merely be flat on their tops and bottoms so that they may be stacked, one on top of the other, or preferably, may include means for interlocking the pieces as they are stacked. Any suitable interlocking means may be used. As shown in FIGS. 5 and 6, spaced, upwardly projecting tabs 18 are provided on the upper surface of each of the playing pieces 16 and similarly spaced receiving holes 19 are provided in the lower surface of each playing piece. Similar receiving holes are provided in the lower surface of each top piece 17. The spacing of the tabs 18 and receiving holes 19 are the same for all playing pieces. As the pieces are stacked, one on top of the other, they are arranged so that the tabs 18 project into and are received by receiving holes 19 thereby interlocking the pieces against relative movement.

If desired, playing boards 10 can be provided with projecting tabs in each construction and discard site so as to interlock with playing pieces placed thereon. The drawing piles on board 11 can also be provided with such interlocking tabs. Other types of interlocking between board and playing pieces could also be used.

Openings 20 in playing pieces 16 allow the pieces to be easily picked up and manipulated.

Figure 7:
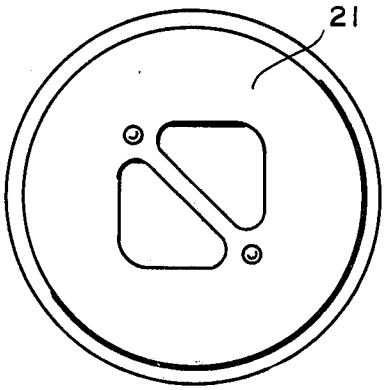

FIG. 7 shows a round playing piece 21. A set of such round pieces would form a cone when properly stacked. While square and round pieces are illustrated, it should be realized that any shape pieces could be used.

In playing the game, the playing pieces, one complete set for each player except for top pieces 17, are randomly divided into four groups and are randomly stacked on the four designated areas 14 of playing board 11. Players in turn then draw the top piece from any one of the four stacks of pieces or, the top piece in any player's discard pile, and either places that piece on one of his construction sites 12 or in his discard pile 13. Rather than drawing a piece on any turn, a player may move a piece from one of his construction sites to another of his construction sites. The object of the game is to be the first player to complete construction of a pyramid. During play, a larger playing piece may never be placed upon a smaller playing piece at any of a player's three construction sites. Although four draw piles are currently preferred, fewer piles could be used.

Figure 3:
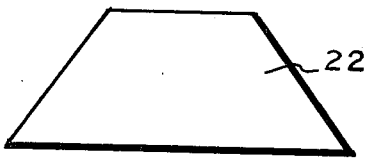
Figure 2:
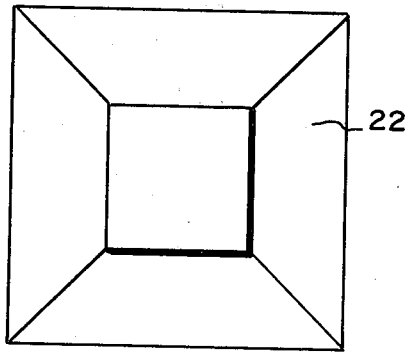

In an alternate form of the game, a box, such as 22, FIGS. 2 and 3, is substituted for board 11 with its draw pile designations. The box may be of any shape, may have a bottom, or may be placed upon board 11 or any surface which can act as its bottom. In this form of the game, the playing pieces, one complete set of playing pieces for each player, are randomly placed in the box. Each player in turn reaches into the box and draws one of the playing pieces. The rules may allow the player to feel the various pieces, without looking at them, and draw a piece which he feels to be one that he may want. The construction of the pyramids proceeds as described above with the object being to construct a complete pyramid on one building site and never to place a larger piece upon a smaller piece during any stage of construction.

Other verisons of the game, such as a solitare version in which a single player starts with a completed pyramid on one site and tries to move it to another site in a minimum number of moves, may be played using the described apparatus.

Any manner of choosing a player to go first may be used. If desired, the top pieces 17 of the pyramid may be placed in a cup that may be provided with the game, and the player who has most top pieces standing right side up when he pours them out of the cup, goes first.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. Game apparatus, comprising a set of a plurality of playing pieces for each player, each piece of the set being of similar geometric shape in one plane but each being of different perimetral size in that plane so that beginning with the piece of largest perimetral size, all of the individual pieces of a set can be stacked to form a shape of progressively diminishing cross section, said pieces of one set being interchangeable with similarly sized pieces of each of the other sets; means for holding all playing pieces so that they may be drawn individually from such means to be placed into play; and playing board means having thereon for each of a plurality of players four designated sites for placement of playing pieces, three of which sites are labeled to indicate they are construction sites and the fourth of which is labeled to indicate that it is a discard site.

2. Game apparatus according to claim 1, wherein the means for holding all playing pieces includes means designating a plurality of sites among which the playing pieces may be randomly distributed and, upon each of which, playing pieces may be randomly stacked.

3. Game apparatus according to claim 2, wherein the playing board means includes a separate playing board for each player, each separate playing board having three construction sites and a discard site thereon.

4. Game apparatus according to claim 3, wherein the playing pieces are square in the plane of similar shape, and the set of pieces, when properly stacked, form a four-sided pyramid.

5. Game apparatus according to claim 1, wherein the means for holding all playing pieces is a container in which the playing pieces may be randomly placed.

6. Game apparatus according to claim 5, wherein the playing board means includes a separate playing board for each player, each separate playing board having three construction sites and a discard site thereon.

7. Game apparatus according to claim 6, wherein the playing pieces are square in the plane of similar shape, and the set of pieces, when properly stacked, form a four-sided pyramid.

8. Game apparatus according to claim 1, wherein the playing board means includes a separate playing board for each player, each separate playing board having three construction sites and a discard site thereon.

9. Game apparatus according to claim 1, wherein the playing board means is a single playing board having all sites thereon.

10. Game apparatus according to claim 9, wherein the means for holding all playing pieces so that they may be drawn individually is a designation of four draw sites on the same playing board whereon the construction and discard sites are located and among which draw sites the playing pieces may be randomly distributed and, upon each of which, the distributed pieces may be randomly stacked.

11. Game apparatus according to claim 1, wherein the playing pieces are square in the plane of similar shape, and the set of pieces, when properly stacked, form a four-sided pyramid.

12. Game apparatus according to claim 1, wherein the playing pieces are round in the plane of similar shape, and the set of pieces, when properly stacked, form a cone.

13. Game apparatus according to claim 1, wherein each playing piece includes means for interlocking it with other playing pieces when such pieces are stacked one on top of the other.

14. Game apparatus according to claim 13, wherein the interlocking means includes upwardly projecting tabs on each but the top piece and corresponding receiving holes in the bottom of each piece adapted to mate and interlock with the tabs projecting from the piece upon which it is stacked.

15. Game apparatus, comprising a set of a plurality of playing pieces for each player, each piece of the set being of similar geometric shape in one plane but each being of different perimetral size in that plane so that beginning with the piece of largest perimetral size, all of the individual pieces of a set can be stacked to form a shape of progressively diminishing cross section, said pieces of one set being interchangeable with similarly sized pieces of each of the other sets; means for holding all playing pieces so that they may be drawn individually from such means to be placed into play; and playing board means having thereon designated playing sites, there being three sites for each player, no more no less, labeled to indicate that they are building sites, and there being site means labeled for discard of playing pieces.

* * * * *